US007850536B1

(12) United States Patent
Fitzgerald

(10) Patent No.: US 7,850,536 B1
(45) Date of Patent: Dec. 14, 2010

(54) PUTTER TRAINER

(75) Inventor: Lisa M. Fitzgerald, Sarasota, FL (US)

(73) Assignee: Novatron Holdings Corporation, Lakeland, FL (US)

( * ) Notice: Subject to any disclaimer, the term of this patent is extended or adjusted under 35 U.S.C. 154(b) by 0 days.

(21) Appl. No.: 12/696,713

(22) Filed: Jan. 29, 2010

Related U.S. Application Data

(60) Provisional application No. 61/148,096, filed on Jan. 29, 2009.

(51) Int. Cl.
*A63B 69/36* (2006.01)

(52) U.S. Cl. ..... 473/220; 473/257

(58) Field of Classification Search ..... 473/219, 473/220, 221, 222, 223, 224, 225, 226, 257, 473/266, 268, 278
See application file for complete search history.

(56) References Cited

U.S. PATENT DOCUMENTS

| | | | | |
|---|---|---|---|---|
| 3,992,011 | A | 11/1976 | Jessee | |
| 4,143,877 | A | 3/1979 | Jeffries | |
| 4,615,526 | A | 10/1986 | Yasuda et al. | |
| 4,963,314 | A | 10/1990 | Gering et al. | |
| 4,979,745 | A | 12/1990 | Kobayashi | |
| 5,082,283 | A | 1/1992 | Conley et al. | |
| 5,330,191 | A | 7/1994 | Hoganson | |
| 5,338,037 | A | 8/1994 | Toyohara | |
| 5,409,232 | A | 4/1995 | Hoganson | |
| 5,435,561 | A | 7/1995 | Conley | |
| 5,577,916 | A | 11/1996 | Gordon | |
| 5,599,239 | A | 2/1997 | Kim et al. | |
| 5,614,823 | A | 3/1997 | Katayama et al. | |
| 5,624,327 | A | 4/1997 | Smith | |
| 5,718,639 | A | 2/1998 | Bouton | |
| 5,728,006 | A | 3/1998 | Teitell et al. | |
| 5,743,807 | A * | 4/1998 | Bendo et al. | 473/234 |
| 5,935,014 | A | 8/1999 | Lindsay | |
| 5,976,022 | A | 11/1999 | Williams | |
| 6,095,928 | A | 8/2000 | Goszyk | |
| 6,227,984 | B1 | 5/2001 | Blankenship | |
| 6,261,189 | B1 | 7/2001 | Saville et al. | |
| 6,371,864 | B1 | 4/2002 | Norwood | |
| 6,375,579 | B1 | 4/2002 | Hart | |
| 6,450,893 | B1 | 9/2002 | Primiano et al. | |
| 6,612,937 | B1 | 9/2003 | Whelan | |
| 6,781,621 | B1 | 8/2004 | Gobush et al. | |
| 6,821,211 | B2 | 11/2004 | Otten et al. | |
| 6,837,799 | B2 | 1/2005 | Cameron et al. | |
| 6,875,122 | B2 | 4/2005 | Collins et al. | |

(Continued)

*Primary Examiner*—Nini Legesse
(74) *Attorney, Agent, or Firm*—Charles J. Prescott

(57) ABSTRACT

A putting training device for improving consistency of body position, putter path, putter face angle, and timing during a putting stroke. A body alignment target within a putter data module helps position the golfer's head directly over the ball for shoulder joint consistently relative to the ball. A magnet is securable to the C.G. of the putter head which is tracked by sensors within the module to help insure that the putter travels in a straight line on approach to ball strike. Optical sensors determine the putter face angle at ball impact. A metronome is also provided to practice swing timing. An end-of-swing delay indicator helps to hold the golfer's body in the correct position until the follow-through is complete. A series of lights and tones provides feedback indicating putter path to the ball and the putter face angle at ball impact.

3 Claims, 17 Drawing Sheets

U.S. PATENT DOCUMENTS

| | | | | |
|---|---|---|---|---|
| 6,887,162 | B2 | 5/2005 | Lindsay | |
| 6,913,541 | B2 | 7/2005 | Chen | |
| 6,935,965 | B1 * | 8/2005 | DeVarney | 473/224 |
| 7,022,026 | B2 | 4/2006 | Blankenship | |
| 7,118,488 | B2 | 10/2006 | Chan et al. | |
| 7,128,657 | B1 | 10/2006 | McCarthy et al. | |
| 7,160,197 | B2 | 1/2007 | James | |
| 7,207,896 | B1 | 4/2007 | Sudol | |
| 7,228,649 | B2 | 6/2007 | Elliott | |
| D546,894 | S | 7/2007 | Meyer et al. | |
| 7,255,649 | B1 | 8/2007 | McConnell | |
| 7,329,193 | B2 | 2/2008 | Plank, Jr. | |
| 7,331,875 | B2 | 2/2008 | Sherman | |
| 7,381,139 | B2 | 6/2008 | Weeks et al. | |
| 2004/0092327 | A1 | 5/2004 | Marnocha | |
| 2004/0106092 | A1 | 6/2004 | Galanis et al. | |
| 2004/0137997 | A1 | 7/2004 | Rohrer | |
| 2006/0281579 | A1 | 12/2006 | Marnocha | |
| 2007/0082325 | A1 * | 4/2007 | Novosel, Sr. | 434/252 |

* cited by examiner

PUTTER TRAINER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the game of golf and particularly to a device for training a golfer to improve the consistency and accuracy of the putter stroke.

2. Description of Related Art

U.S. Pat. No. 5,624,327 to Smith discloses a golf putting practice device which provides visual feedback to the user, comprising a head position indicator and a device for determining that that the putter has been maintained in the proper position.

Whelan teaches a golf swing training device that assists in the control of head and body position during a golf swing in U.S. Pat. No. 6,612,937. A golf club and target practice apparatus that facilitates development of proper club head aiming techniques is disclosed by Marnocha in U.S. Patent Application Publication 2006/0281579.

U.S. Pat. No. 5,728,006 to Teitell et al. discloses a magnetic golf club swing sensor and simulation system for golf game. An electronic golf training device is taught by Yasuda et al. in U.S. Pat. No. 4,615,526.

Blankenship teaches golf club swing analyzers and golf swing analysis methods in U.S. Pat. No. 6,227,984. A putter training device is taught by Norwood in U.S. Pat. No. 6,371,864.

U.S. Pat. No. 4,979,745 to Kobayashi discloses an electronic device for practicing a golf swing which can be used to measure a speed of a golf club head, a degree of inclination of a face of the golf club head, and a degree of inclination of an axis of a swing of a golf club with respect to a golf ball at any location.

An apparatus and method for measuring head speed and an opening angle are disclosed in U.S. Pat. No. 5,614,823 to Katayama et al. A golf club head attitude detecting device is taught by Weeks et al. in U.S. Pat. No. 7,381,139.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a putting training device for improving consistency of body position, putter path, putter face angle, and timing during a putting stroke. A body alignment target within a device module helps position the golfer's head directly over the ball for shoulder joint consistently relative to the ball. A magnet is securable to the C.G. of the putter head which is tracked by sensors within the module to help insure that the putter travels in a straight line on approach to ball strike. Optical sensors determine the putter face angle at ball impact. A metronome is also provided to practice swing timing. An end-of-swing delay indicator helps to hold the golfer's body in the correct position until the follow-through is complete. A series of lights and tones provides feedback indicating putter path to the ball and the putter face angle at ball impact.

It is an object of this invention to provide a putter trainer which is easily deployable for putting practice in conjunction with virtually any level surface including carpet and grass.

It is another object of this invention to provide a putter trainer which strengthens consistent putter swing movement for enhanced putting accuracy.

Yet another object of this invention is to provide a putter trainer which provides viewable and/or audible indicia of the accuracy of body positioning, putter back swing and follow-through, and club head squareness and path for each practice stroke.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

List of Components

| | |
|---|---|
| 1 | putter data module |
| 2 | putter |
| 3 | ball |
| 4 | ball ramp |
| 5 | ball guide |
| 5a | slotted apertures |
| 6 | ball rest dimple |
| 7 | manual power switch |
| 8 | Magnetic-actuated power switch |
| 9 | metronome on/off switch |
| 10 | metronome frequency adjustment switch |
| 11 | base |
| 12 | graphics panel |
| 13 | indicator arrows |
| 14 | club face |
| 15 | magnet |
| 16 | magnet retainer |
| 17 | adhesive pad |
| 18 | center line plane |
| 19 | left club face sensor |
| 20 | right club face sensor |
| 21 | ball sensor |
| 22 | target |
| 23 | reflective left target wall |
| 24 | reflective right target wall |
| 25 | left target LED illuminator |
| 26 | right target LED illuminator |
| 27 | center line LED indicator |
| 28 | error left LED indicator |
| 29 | error right LED indicator |
| 30 | speaker |
| 31 | microphone |
| 32 | printed wiring board |
| 33 | microprocessor |
| 34 | battery |
| 35 | battery charger connector |
| 36 | system block diagram |
| 37 | charge indicator LED |
| 38 | printed wiring board assembly |
| 39 | putter center of gravity indicator |
| 40 | feet |
| 41 | screw |
| 42 | ball path |
| 43 | putter path |
| 44 | embedded magnetic sensor |
| 45 | Hall effect device |
| 46 | deck plate |
| 47 | infrared transmitter |
| 48 | infrared receiver |
| 49 | reflective surface |
| 50 | magnetic flux lines |

Figure 1:
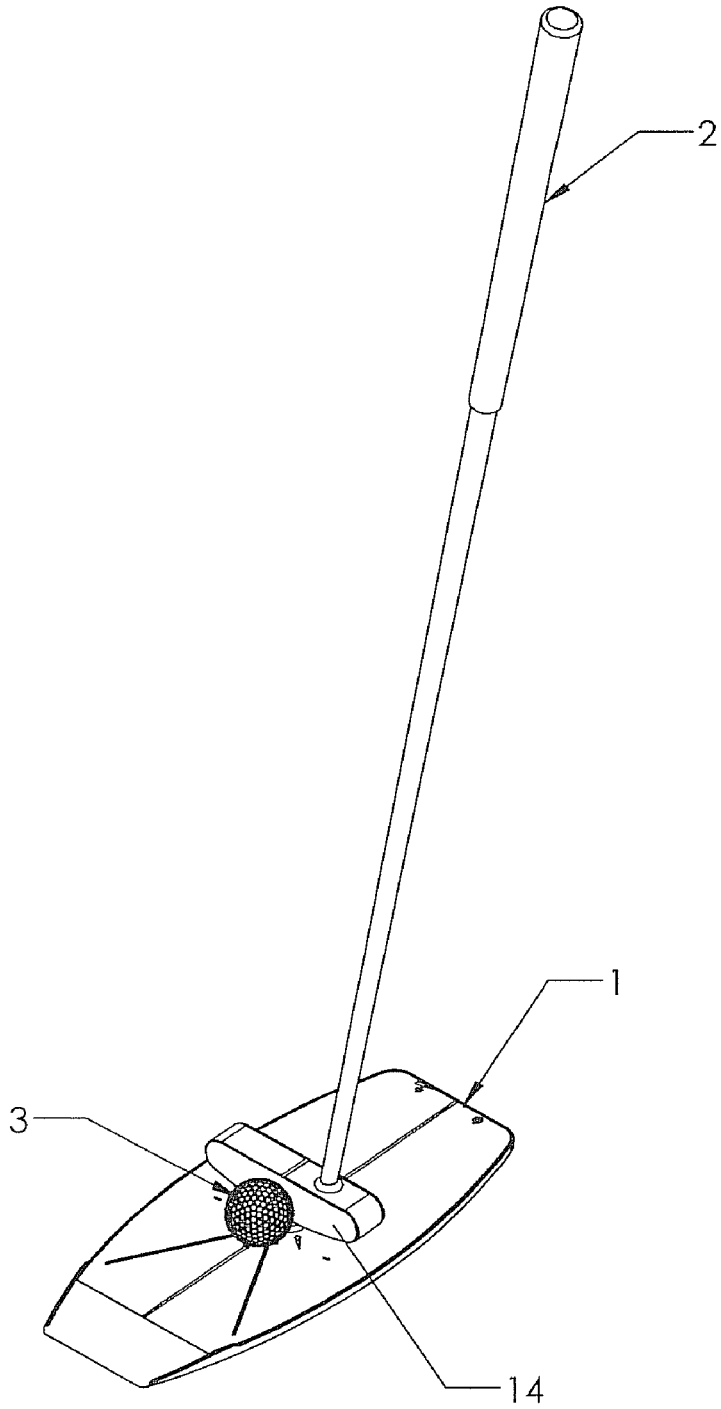
FIG. 1 is a perspective view of the putter trainer in conjunction with a putter and a golf ball in the in-use position.
Figure 2:
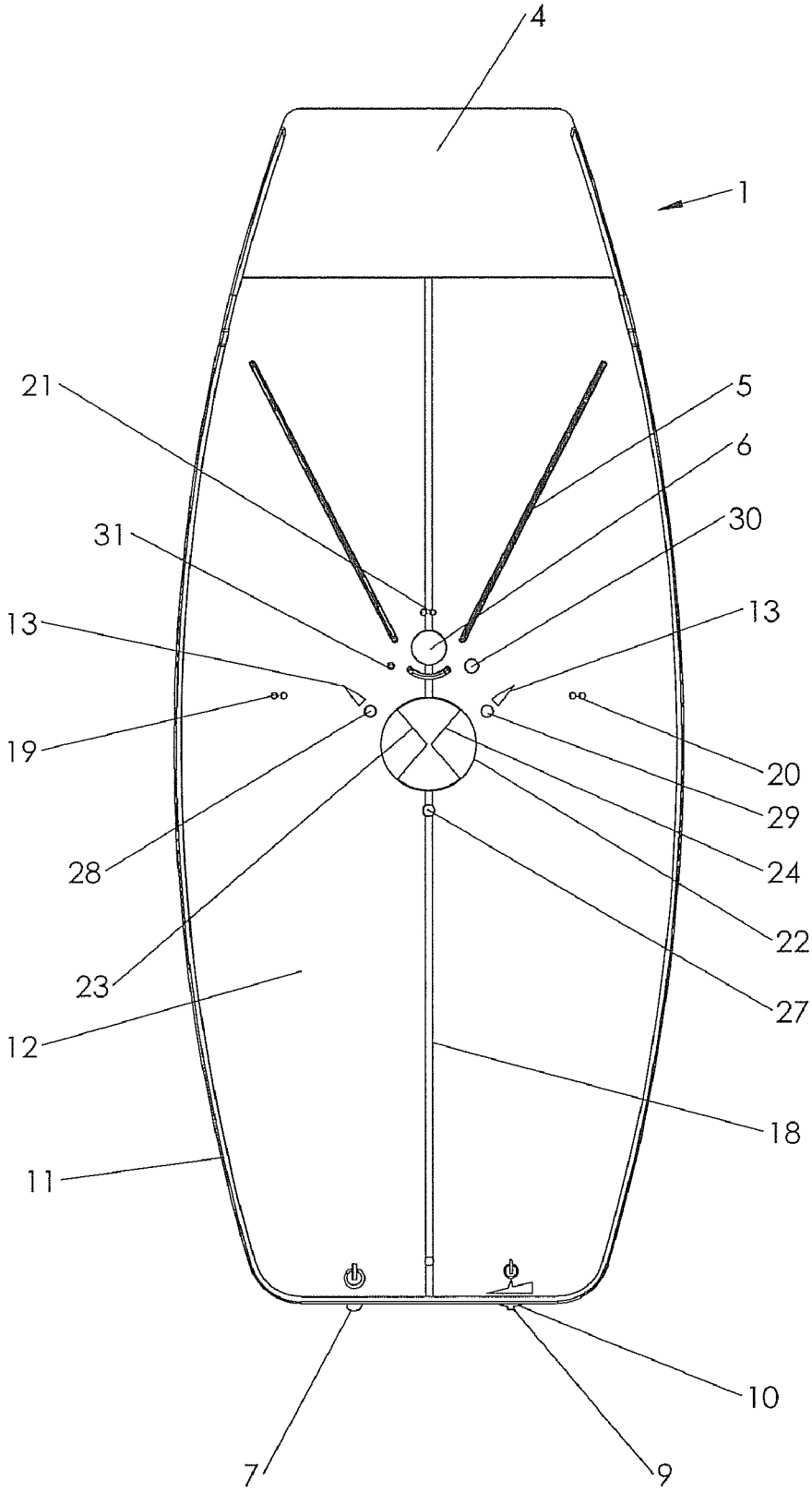
FIG. 2 is a top plan view of the putter data module.
Figure 4:
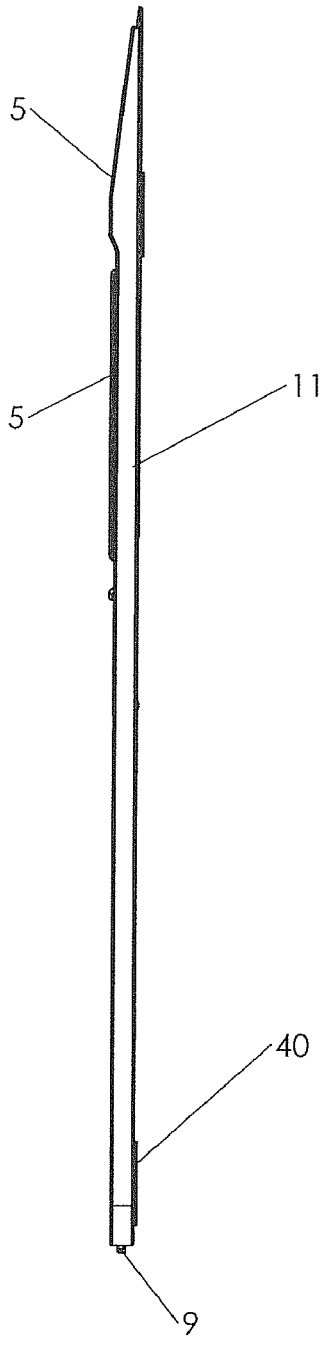
FIG. 4 is a side elevation view of FIG. 3.
Figure 3:
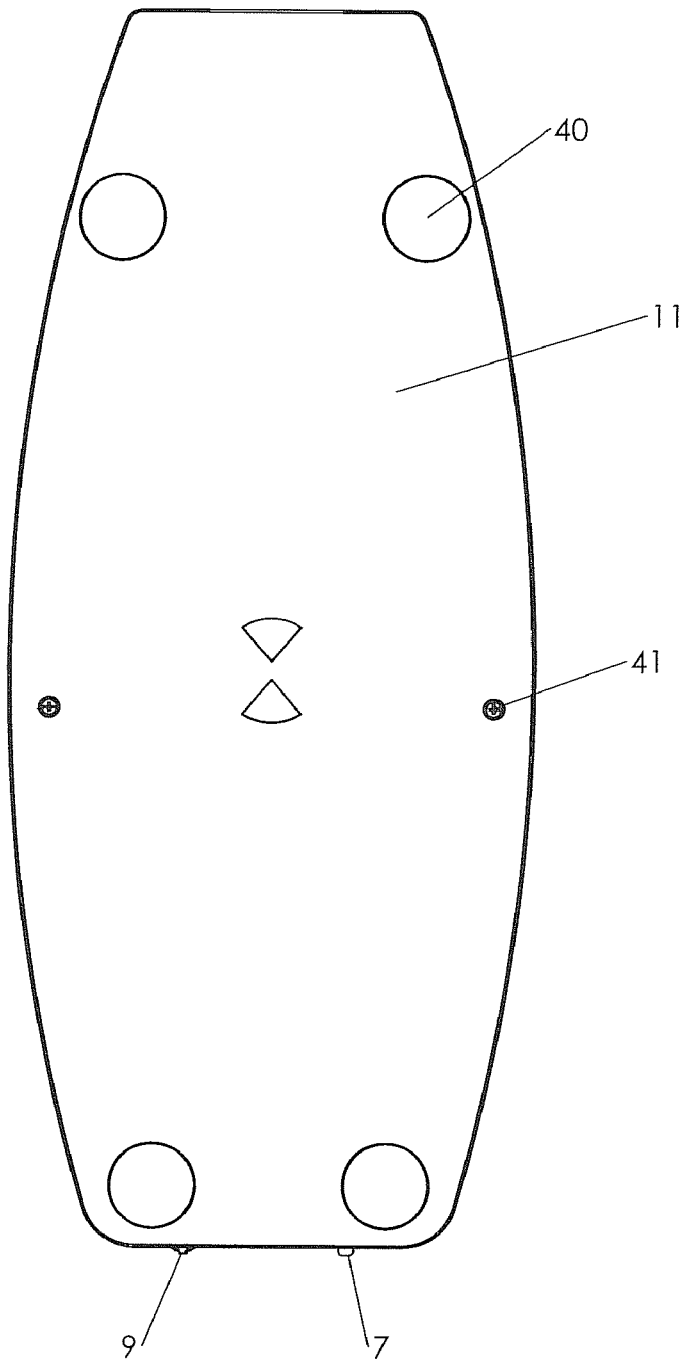
FIG. 3 is a bottom plan view of the putter data module.
Figure 6:
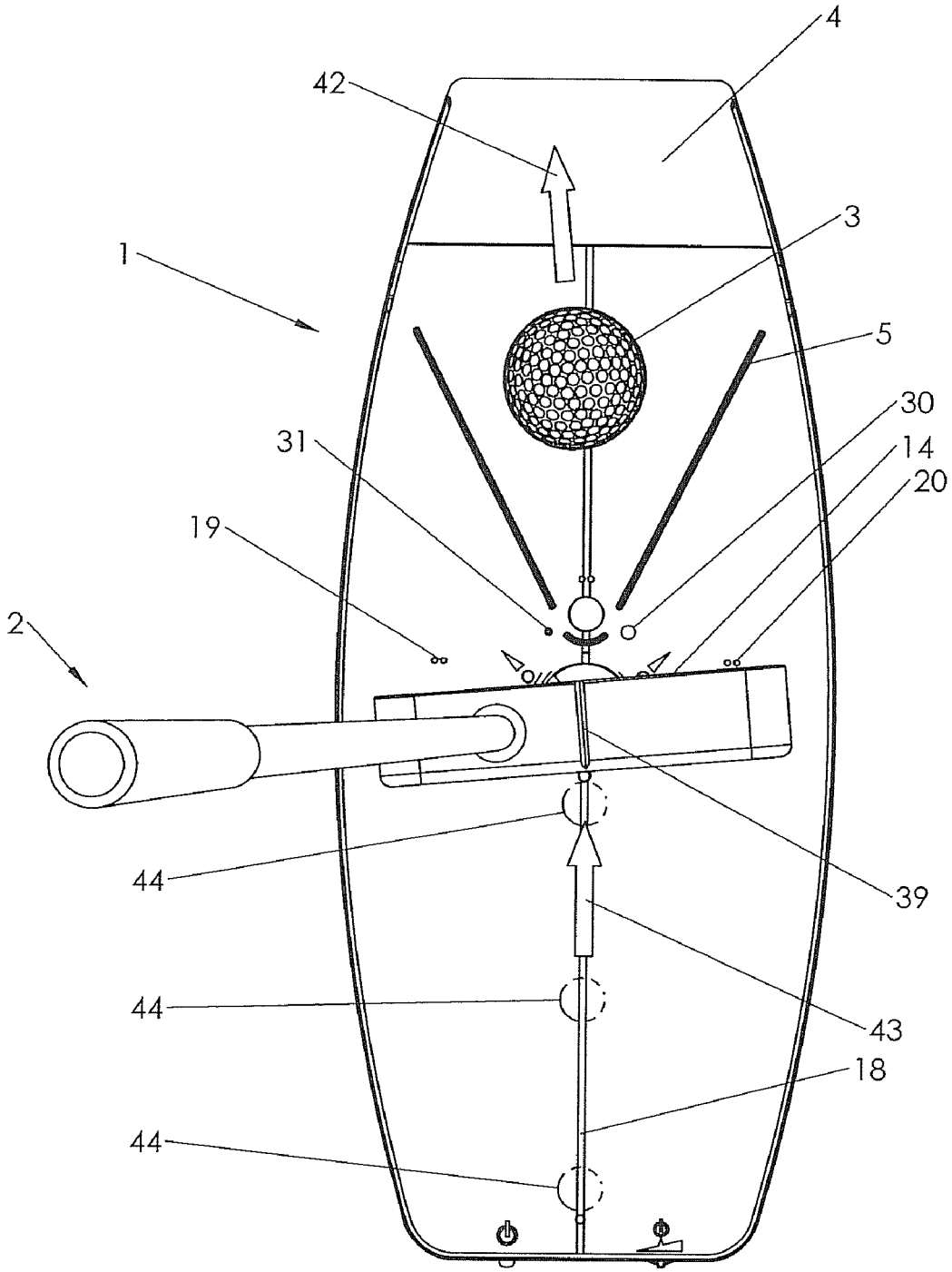
FIG. 6 is a view of FIG. 5 wherein the golf putter face is improperly oriented to the left of the desired orientation causing the golf ball to move to the left of the desired path.

Referring now to the drawings, and firstly to FIGS. 1 and 6, the putter training device includes a putter data module 1 in conjunction with a magnet 15 and magnet retainer 16 adhesively attached to a lower surface of a head of a golf putter 2. When ball 3 is struck, the putter data module 1 collects data on the position of the putter club face 14 and putter path 43 to the ball.

Ref. FIGS. 2, 3, 4, 8, 9, 14, 15 & 16 and 26, the putter data module 1 (shown in FIGS. 9 and 14 with graphics panel 12 and deck plate 46 removed) includes a printed wiring board assembly 38 to collect and display data to the golfer. This assembly 38 is captured between the deck plate 46 and the base 11 using a plurality of screws 41. The deck plate 46 is covered with a graphics panel 12 with a printed graphic line to indicate center line plane 18 and various labels for the controls and indicators. The device 1 is placed on the floor or ground (the natural position for putting) and is prevented from slipping by rubber feet 40. The printed wiring board assembly 38 includes a printed wiring board 32 which electrically connects and constrains the system battery 34, a microphone 31, a speaker 30, a microprocessor 33, a left club face sensor 19, a right club face sensor 20, a ball sensor 21, a left target LED illuminator 25, a right target LED illuminator 26, a center line LED indicator 27, an error left LED indicator 28, an error right LED indicator 29, three embedded magnetic sensors 44, a magnetic-actuated power switch 8, a manual power switch 7, various other electronic components (not shown), a battery charger connector 35, and a combined switch made from the metronome on/off switch 9 and metronome frequency adjustment switch 10.

Ref. FIGS. 1, 4, 5, 8 & 12, the ball 3 placement is fixed by a ball rest dimple 6 on the deck plate 46. An aperture in the graphics panel 12 exposes the ball rest dimple 6 to the bottom of ball 3. A ball guide 5 is molded into deck plate 46 and extends through slotted apertures 5*a* in graphics panel 12. This allows the ball 3, using putter 2, to be pushed onto the putter data module 1 via ball ramp 4 and then further guided by ball guide 5 to ball rest dimple 6.

Figure 25:
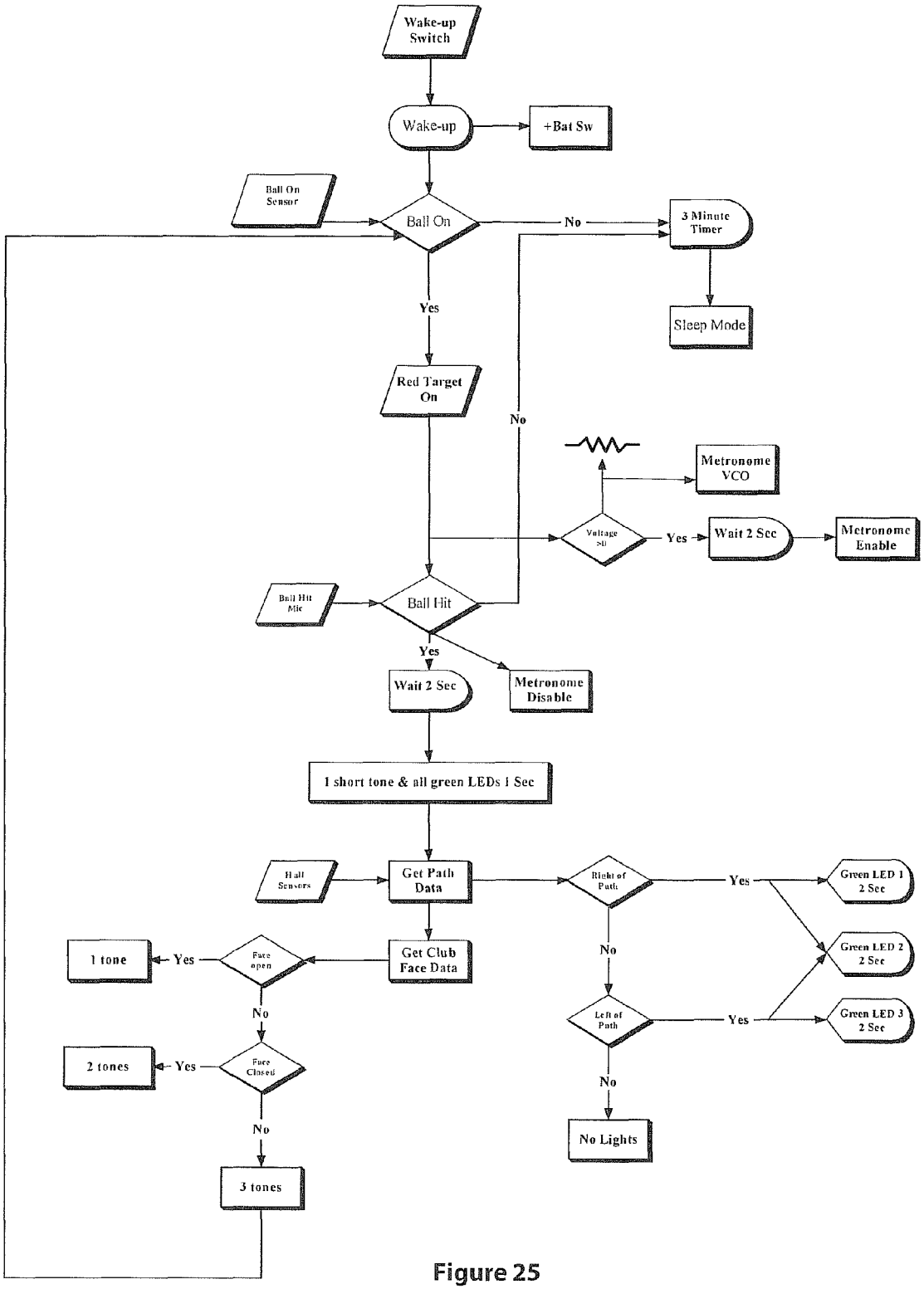
FIG. 25 is a flow diagram of the circuit logic of the data module.
Figure 26:
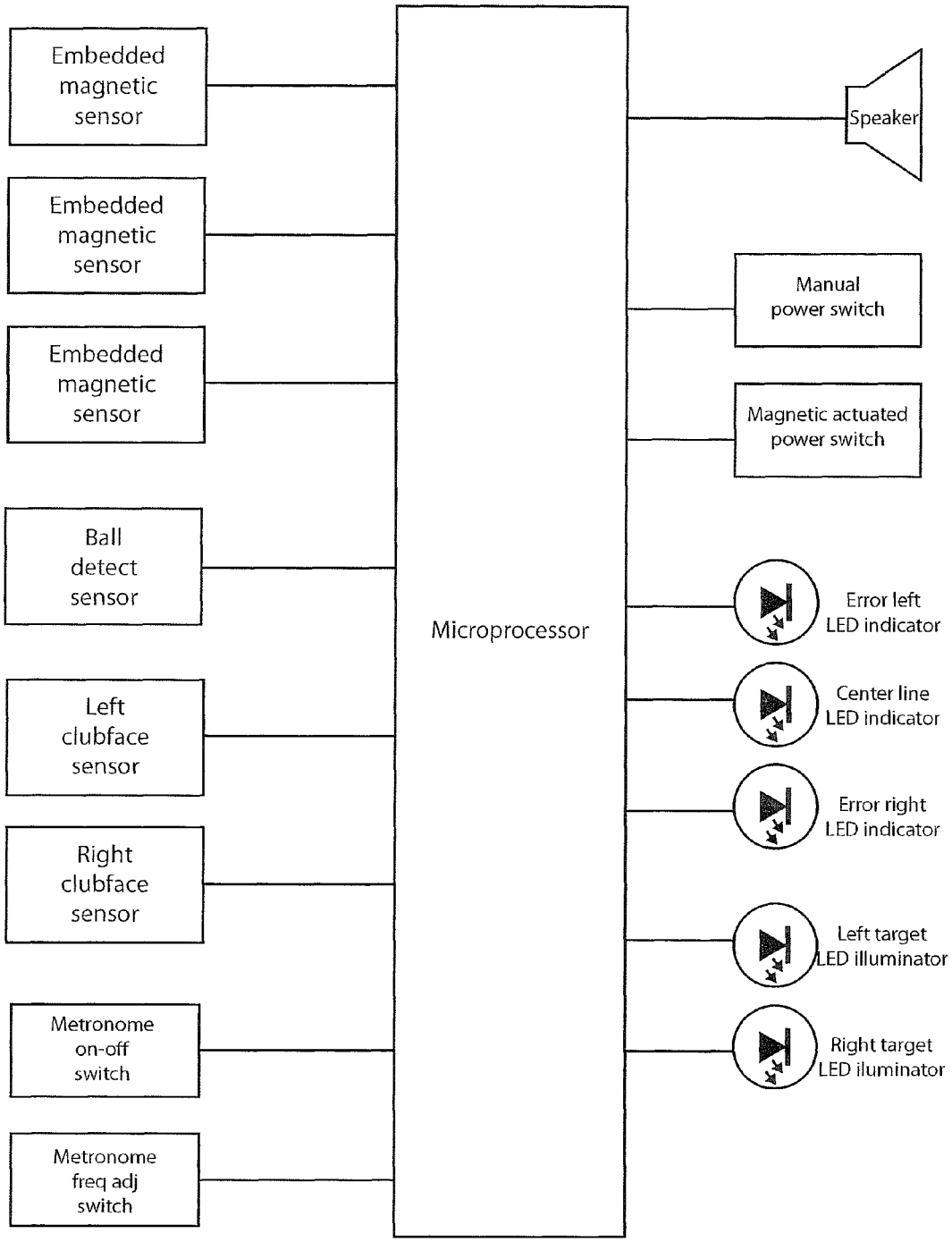
FIG. 26 is a block diagram of the microprocessor, the sensors, control switches and audible and viewable indicia depicting the results and accuracy of each putting stroke.

Ref. FIGS. 2, 9, 14 and 16, to detect when a ball 3 is present and to start system functions as per FIG. 25 flow chart, the ball sensor 21 detects the ball 3 by means of an infrared transmitter 47 illuminating the ball 3 surface and an infrared receiver 48 detecting this illumination. This sends a signal to the microprocessor 33 on printed wiring board 32 that enables target 22 and the metronome, a software function in microprocessor 33 as shown in FIGS. 25 and 26. This metronome produces a rhythmic tone from speaker 30 on printed wiring board 32. This metronome is adjusted and enabled from a ganged switch including a metronome on/off switch 9 and metronome frequency adjustment switch 10. The metronome sets a tempo for the golfer's back swing to develop a more consistent putt.

The golfer's proper head position directly over the golf ball 3, and therefore body position, is established by maintaining sight of target 22. This fixes the golfer's body position for every putt. This target 22 is illuminated by means of left target LED illuminator 25 and right target LED illuminator 26 reflecting off reflective left target wall 23 and reflective right target wall 24. Target wall 23 and reflective right target wall 24 are constructed as two wall segments at a fixed angle relative to the center line plane 18. This allows 360 degree target acquisition based on reflective light.

Figure 21:
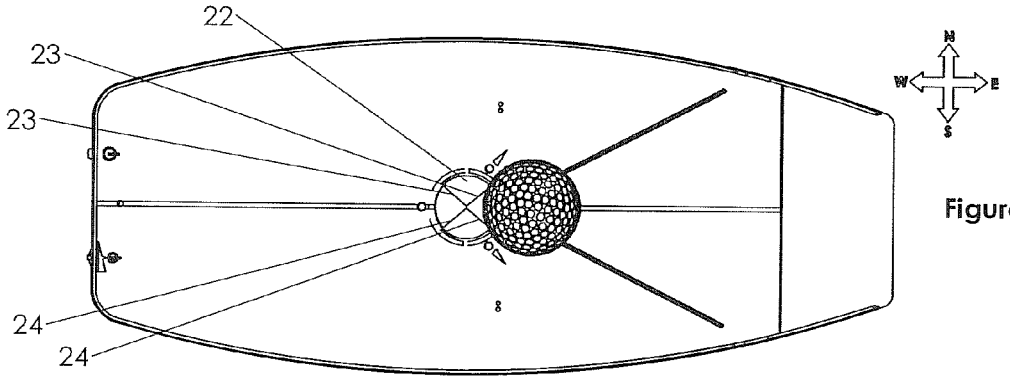
FIGS. 21 to 24 are top plan views of the data module and a golf ball positioned thereatop ready for ball strike and indicating the golfer's line of sight view of the target 22 when the positioning of the golfer's head and body is correctly positioned in FIG. 21 or incorrectly positioned in FIGS. 22 to 24.
Figure 22:
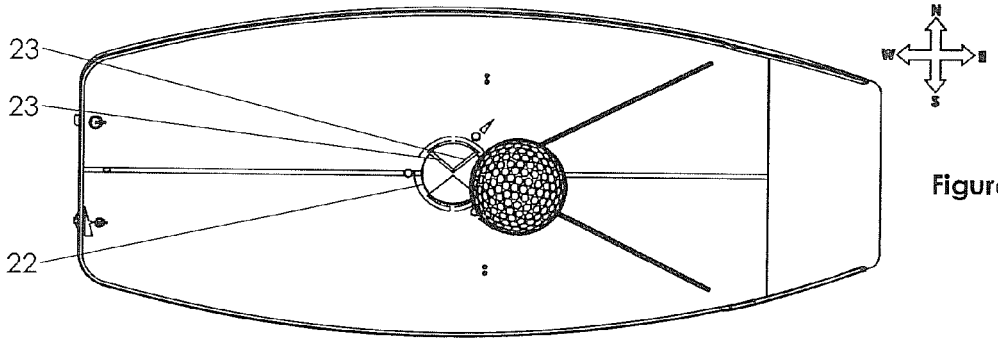
Figure 23:
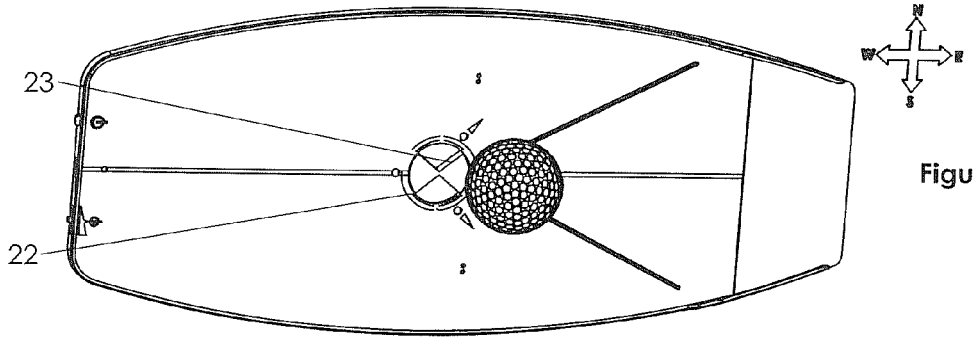
Figure 24:
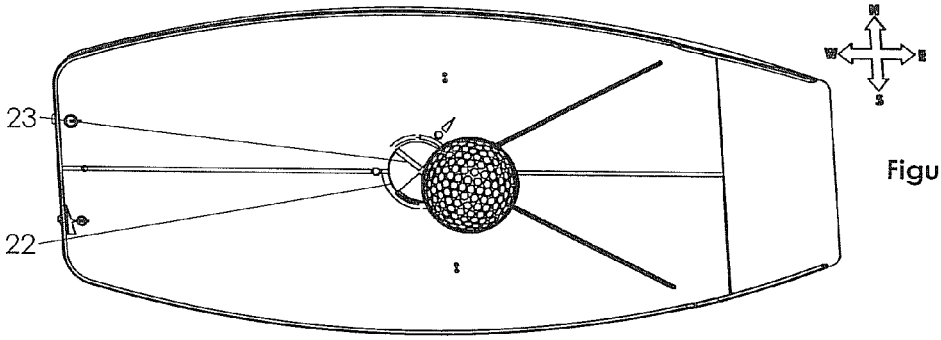

Ref. FIGS. 21, 22, 23 & 24, as the golfer's head moves from the desired position a light feedback system provides viewable indicia of inconsistent head and body positioning. FIG. 21 shows what the golfer sees when in the correct position directly over the ball with no light visible due to reflective left target wall 23 and reflective right target wall's 24 perpendicular plane relative to the visual plane. FIG. 22 shows the golfers head north of desired position, (ref. compass rose FIG. 22), which allows reflective left target wall 23 to come into the golfer's view. The visible light indicates off-target to the north. FIG. 23 shows the golfer's head north and west of desired position, (ref. compass rose FIG. 23), which allows east half of reflective left target wall 23 to come into the golfer's view. The visible light indicates off target to the northwest. FIG. 24 shows the golfer's head north and east of desired position, (ref. compass rose FIG. 24), which allows west half of reflective left target wall 23 to come into the golfer's view. The visible light indicates off-target to the northeast. As the golfer's head moves southward, the same light feedback as describe is indicated using right target wall 24. This feedback allows the golfer's head to center on target 22, regardless of the golfer's standing position for a right- or left-handed golfer.

Ref. FIGS. 2, 6, 7, 8, 9, 14, 15, 16, 17, & 18, the putter path 43 for the last 150 mm before the putter 2 club face 14 impacts ball 3 is determined by three embedded magnetic sensors 44 placed at equal intervals along the centerline plane 18. The embedded magnetic sensors 44 include two hall effect devices 45 located under the graphics panel 12, one on the right and one on the left of center line plane 18.

Figure 5:
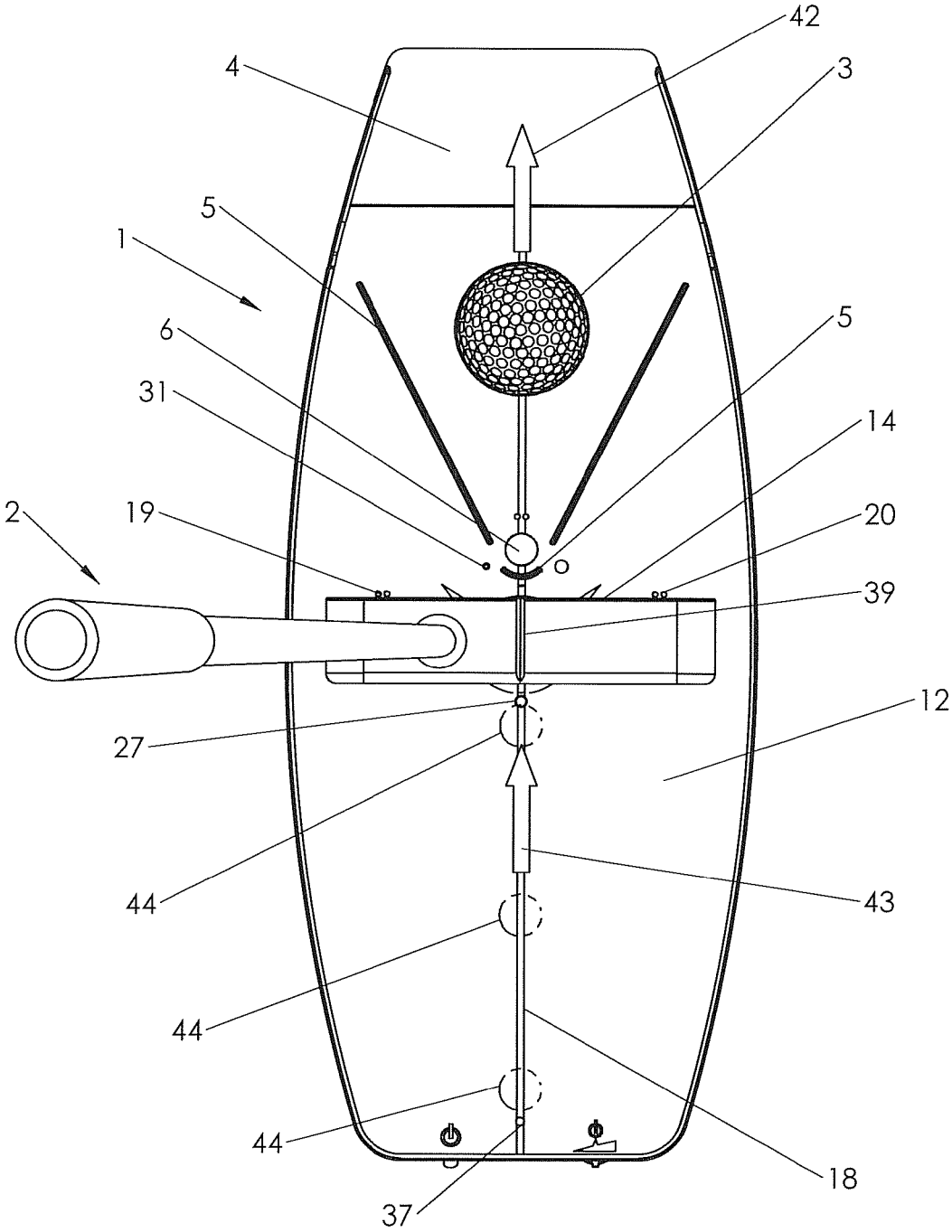
FIG. 5 is a top plan view of FIG. 1 including the golf putter, a golf ball after being struck by the putter, and the correct direction of movement of the golf putter head and the golf ball and proper club face orientation.

Ref. FIGS. 10, 11, 12, & 13, the putter 2 is configured with a magnet 15 molded into magnet retainer 16 that is affixed to the putter 2 by means of an adhesive pad 17. The magnet 15 is placed at the on putter 2 opposite the putter center of gravity indicator 39. This center of gravity indicator 39 is typically marked on most putters to indicate the sweet spot (center of gravity) and is the desired ball impact zone for consistent putts. Ref. FIG. 5, during the forward stroke, for 150 mm (or some pre-defined distance) before ball 3 impacts, the putter travels exactly down putter path 43 coincidental to center line plane 18 to putt the ball 3 in the desired ball path 42.

Figure 7:
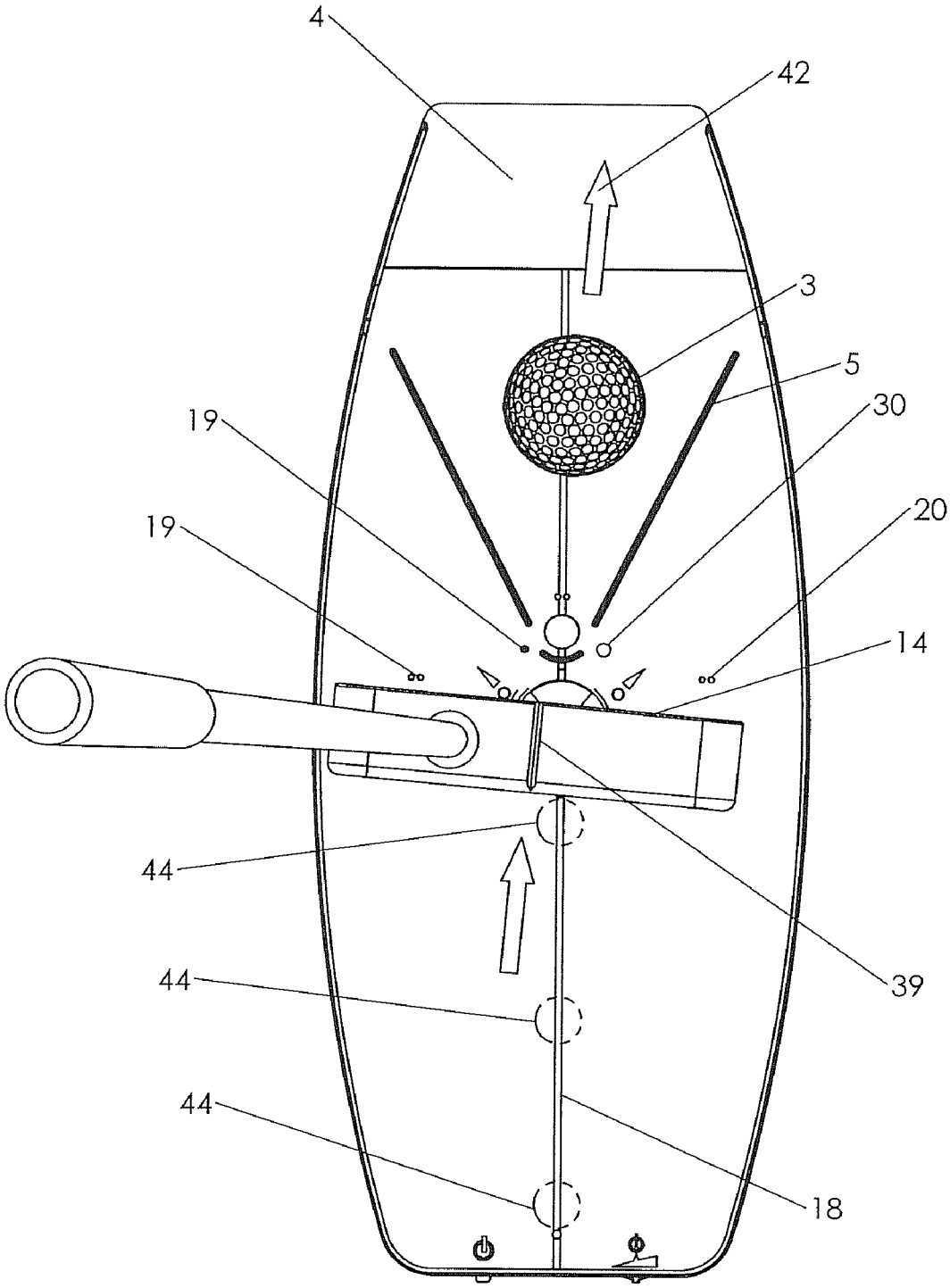
FIG. 7 is a view of FIG. 5 showing the golf putter face oriented to the right of a proper orientation and moving in a direction to the right of the desired path.
Figure 8:
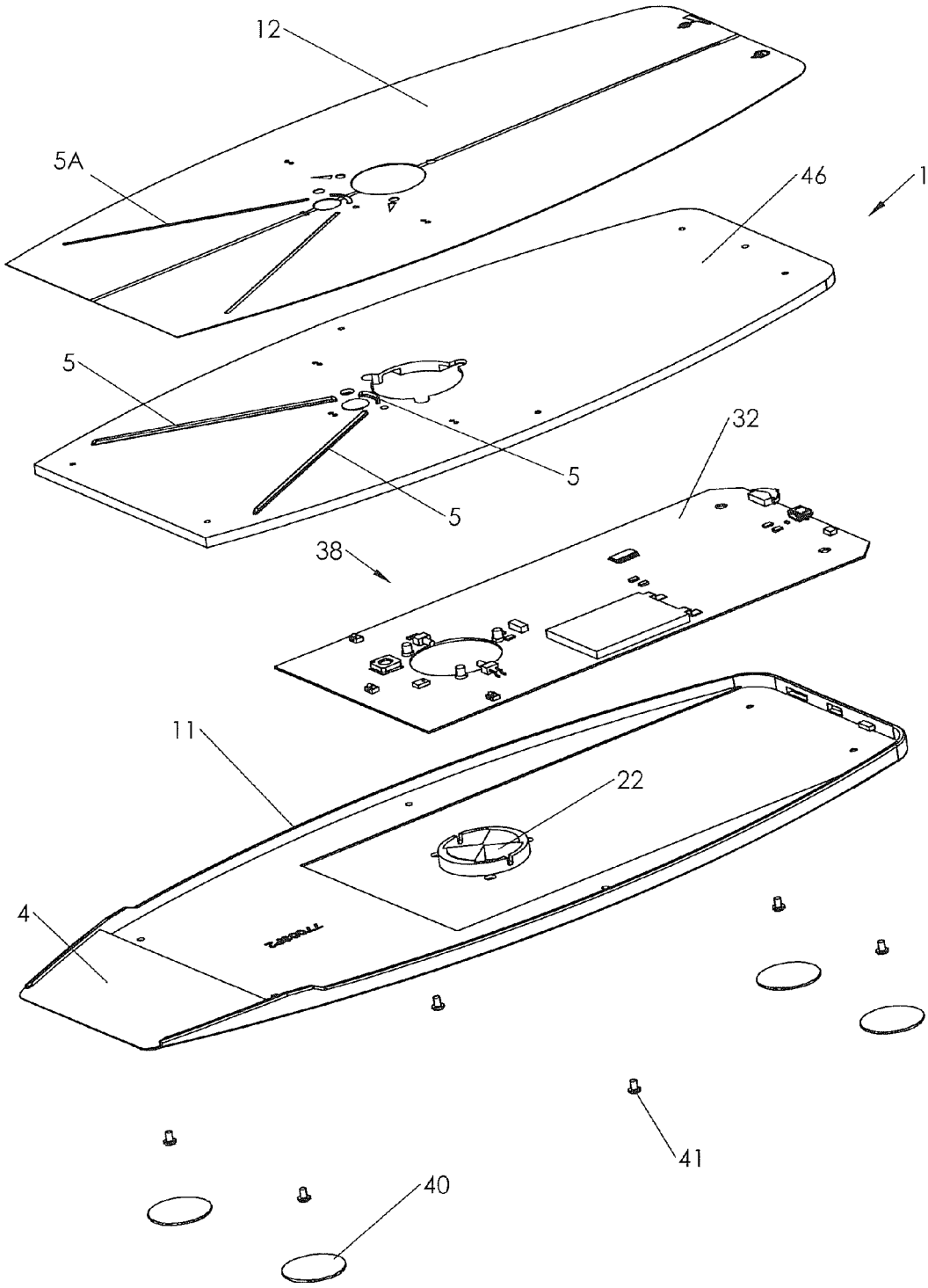
FIG. 8 is an exploded view of the data module.
Figure 9:
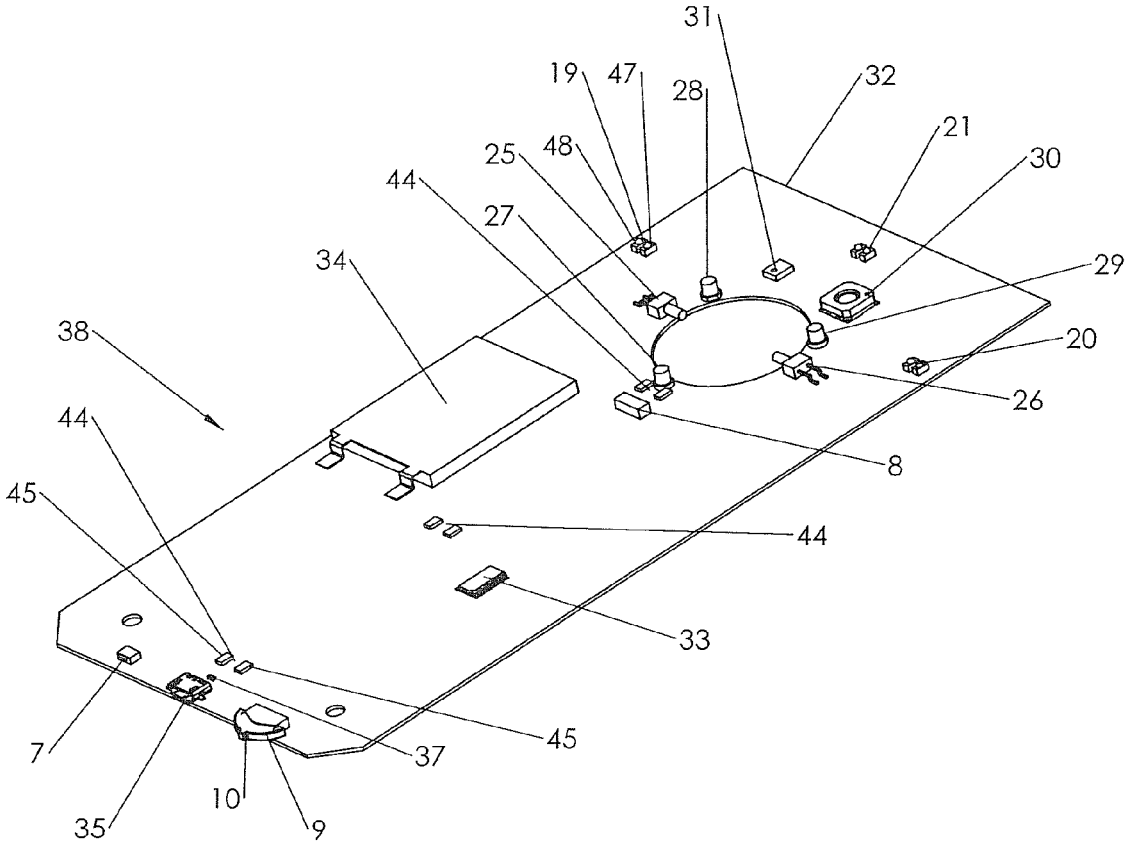
FIG. 9 is a perspective view of the printed wiring board of the data module.
Figure 11:
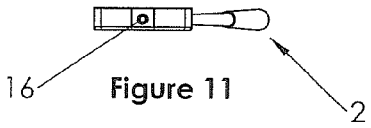
FIG. 11 is a bottom plan view of FIG. 10.
Figure 10:
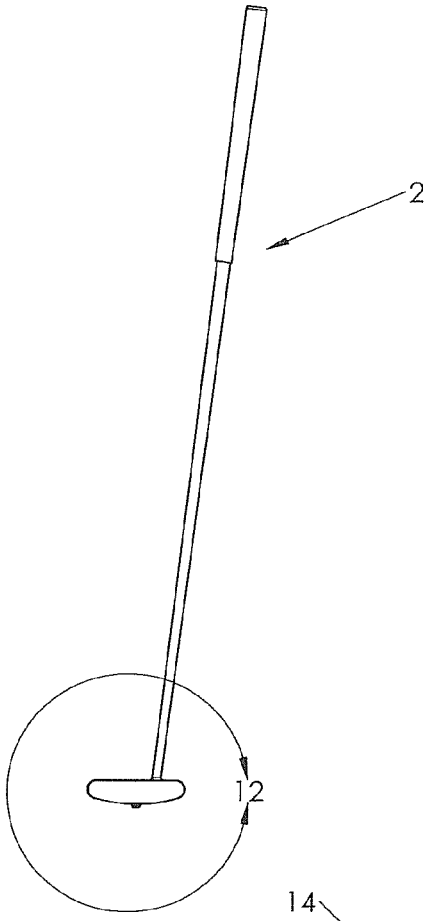
FIG. 10 is a side elevation view of the golf putter with the magnet and magnet retainer attached to the bottom of the putter head.
Figure 12:
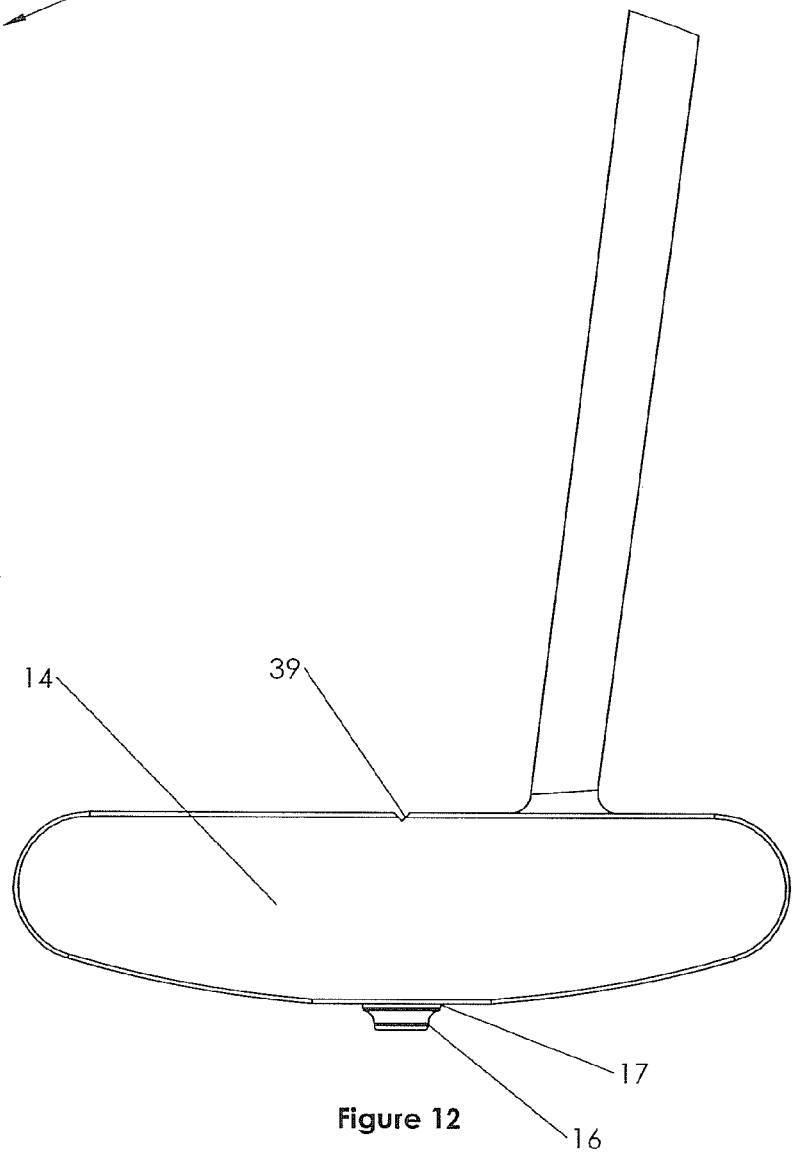
FIG. 12 is an enlarged view of area 12 in FIG. 10.
Figure 13:
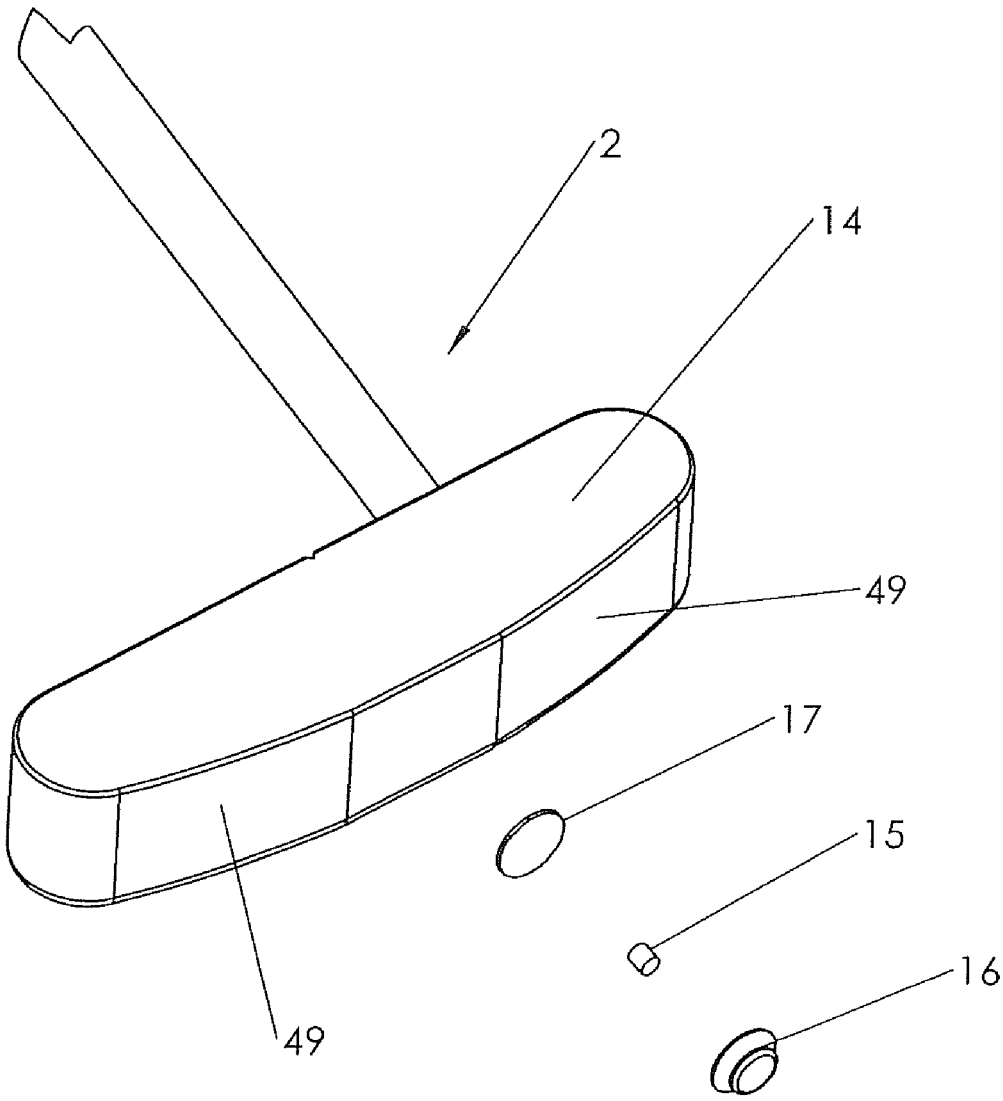
FIG. 13 is an exploded perspective view of FIG. 12.
Figure 14:
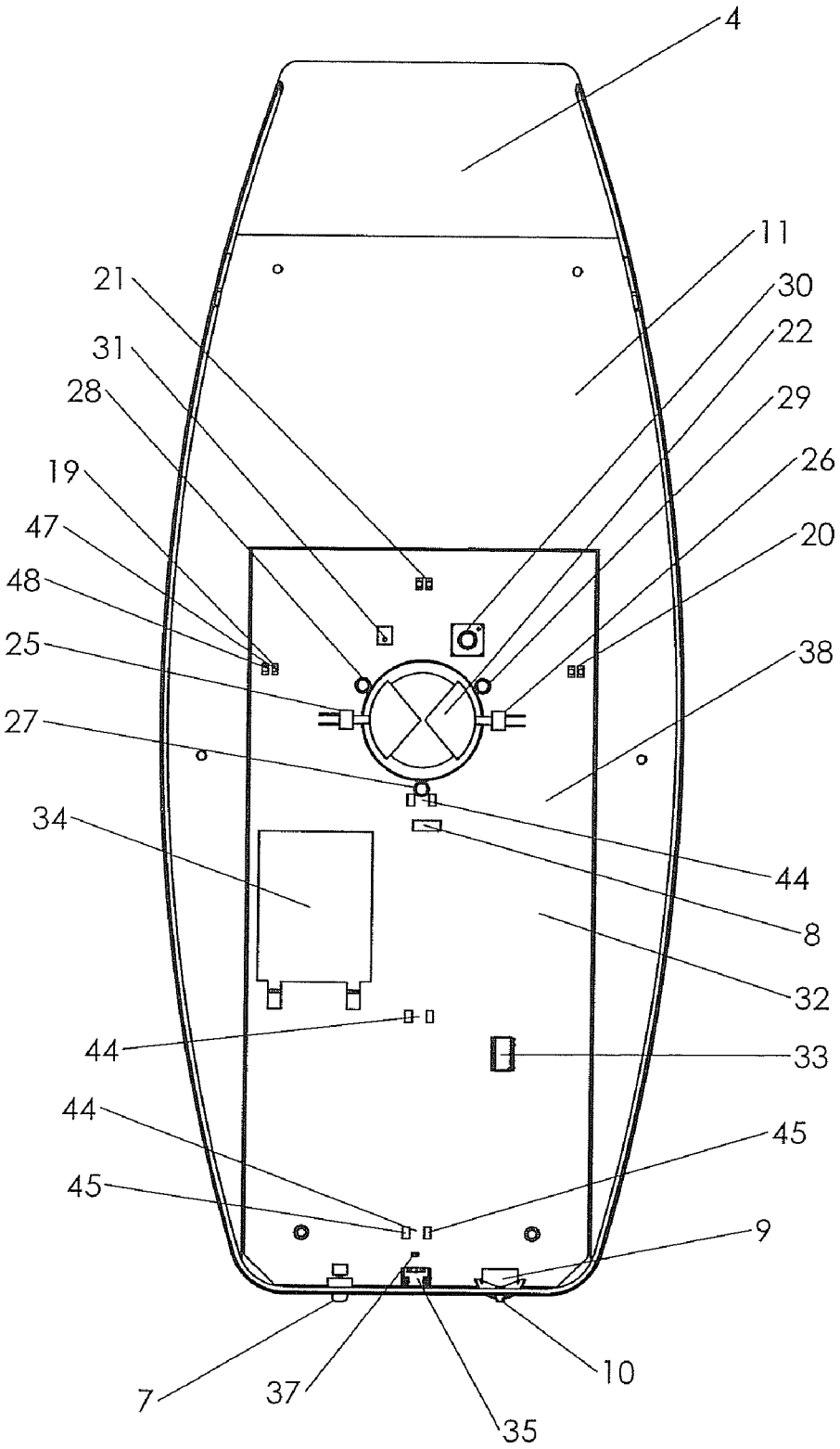
FIG. 14 is a top plan view of the base and printed wiring board of the data module.
Figure 15:
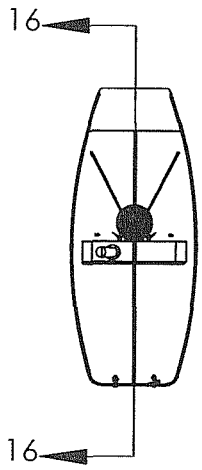
FIG. 15 is a simplified view of FIG. 5.
Figure 16:
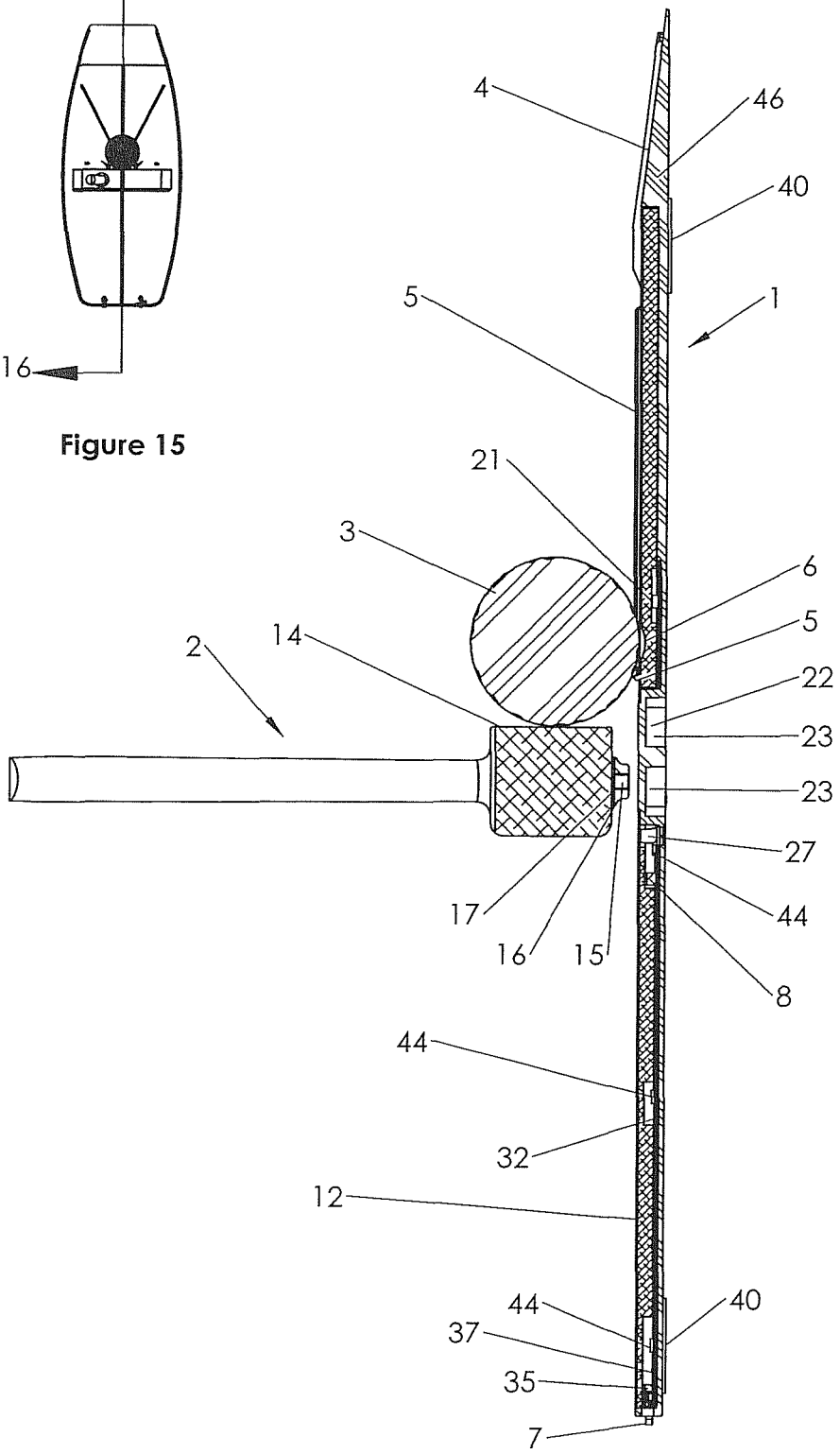
FIG. 16 is a section view in the direction of arrows 16-16 in FIG. 15.
Figures 17, 18, 18A:
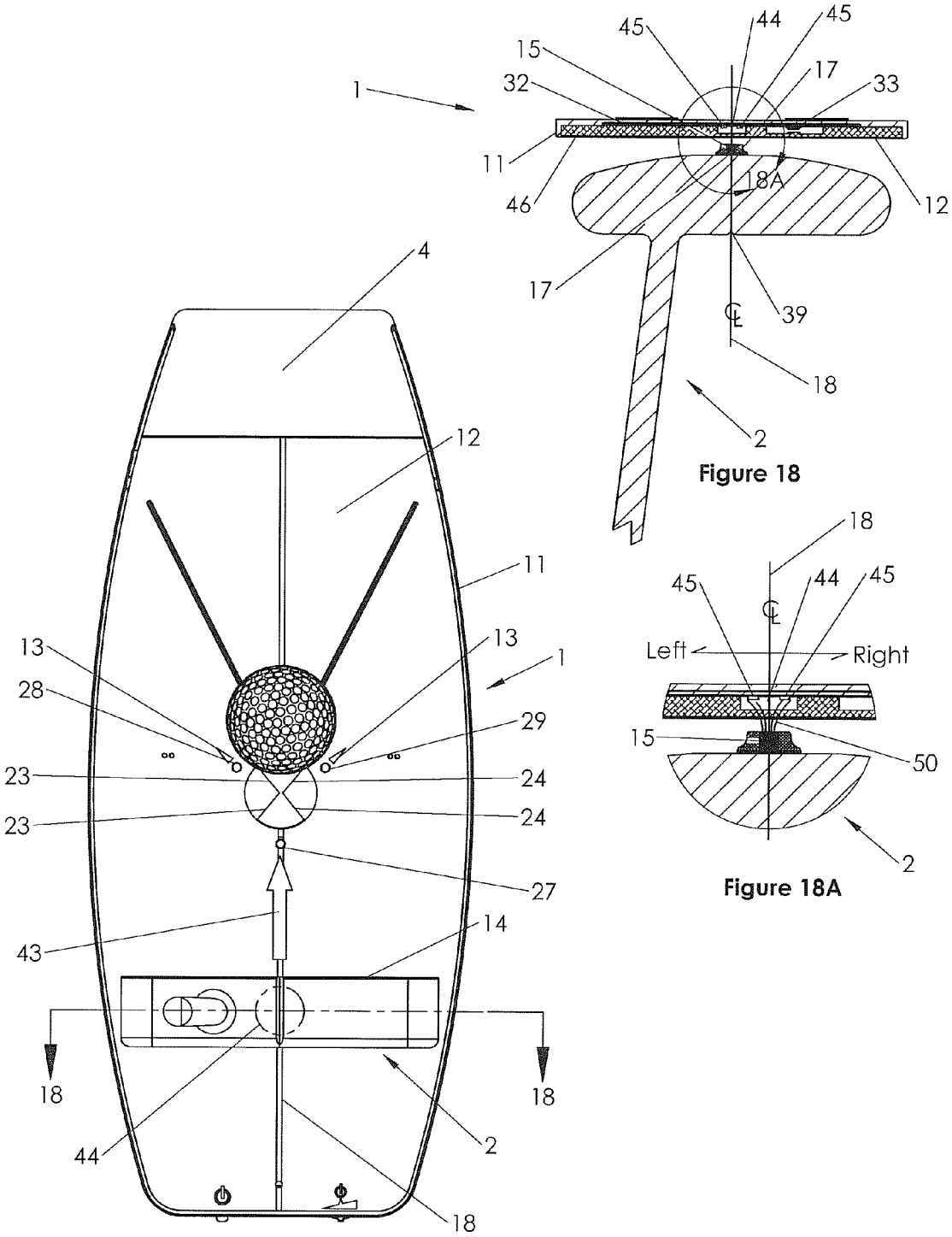
FIG. 17 is a view of FIG. 5 just prior to ball strike.
FIG. 18 is a section view in the direction of arrows 18-18 in FIG. 17.
FIG. 18A is an enlargement of area 18A in FIG. 18.

Ref. FIG. 18A, in the desired putt stroke, the putter 2 travels along center line plane 18 and magnet 15 travels directly between the two hall effect devices 45 that comprise each of the embedded magnetic sensors 44. In this relationship, the magnet 15 imparts magnetic flux lines 50 to each hall effect device 45 equally. The hall effect device 45 output voltage is controlled by the magnet flux acting on the device 45. This information is sent to microprocessor 33. If all three embedded magnetic sensors 44 show the putter path 43 to track down the center line plane 18, the microprocessor 33 commands center line LED indicator 27 to illuminate. Ref. FIG. 7, if the putter 2 center of gravity indicator 39 and magnet 15 is not coincidental to center line plane 18, (in this case left of the center line plane 18) the magnet 15 imparts magnetic flux lines 50 more to the left hall effect device 45 and less to the right hall effect device 45. The microprocessor 33 reads this voltage and commands error left LED indicator 28 or error right LED indicator 29 to illuminate based on the side of the center line plane 18 before impact with ball 3.

Figure 20:
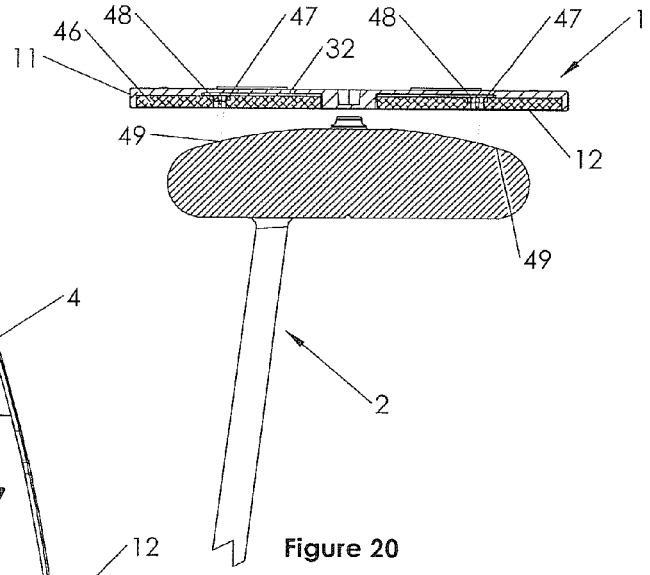
FIG. 20 is a section view in the direction of arrows 20-20 in FIG. 19.
Figure 19:
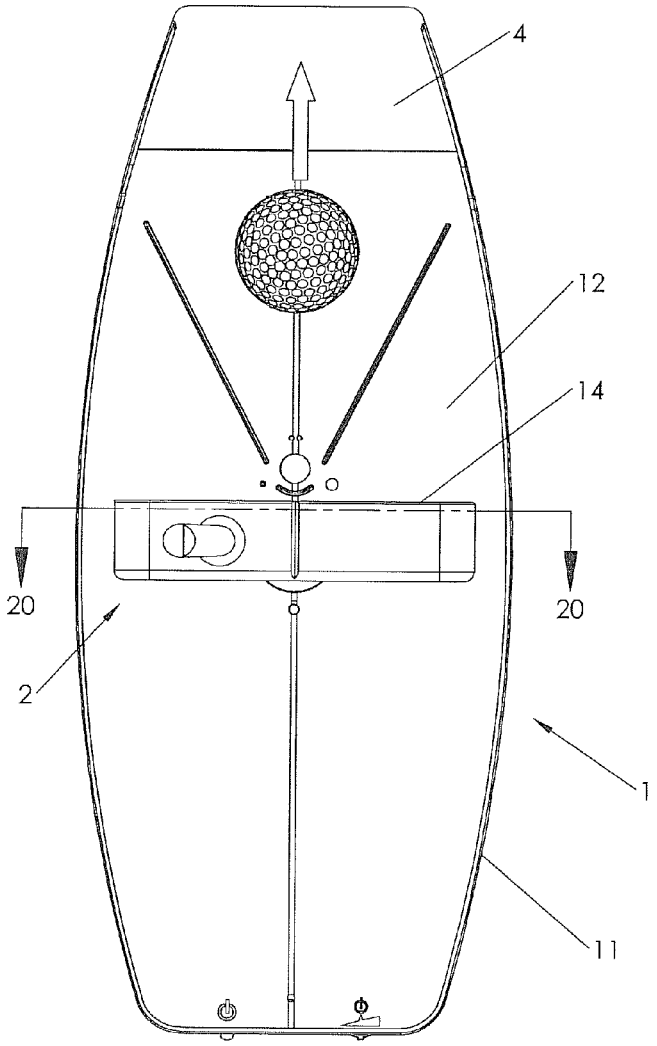
FIG. 19 is a reproduction of FIG. 5.

Ref. FIGS. 2, 8, 9, 14, & 19, as the club face 14 on putter 2 impacts ball 3, microphone 31 detects the impact and sends this information to microprocessor 33. At this point in time, the club face 14 on putter 2 passes over the left club face sensor 19 and right club face sensor 20. Ref. FIG. 20, the club face sensor 19 and right club face sensor 20 include an infrared transmitter 47 and an infrared receiver 48 pair. Ref. FIG. 5, upon impact as detected by microphone 31, the microprocessor 33 interrogates each sensor 19 and 20 to determine when the time a signal was received from reflective surface 49 on putter 2. If left club face sensor 19 and right club face sensor 20 signals were coincident in time, the microprocessor 33 sends three beeps to speaker 30 indicating to the golfer that the club face 14 was perpendicular to center line plane 18. In this case ball 3 follows ball path 42 along center line plane 18, hopefully to the hole. Ref. FIG. 6, if right club face sensor 20 signal was detected before left club face sensor 19, the microprocessor 33 sends two beeps to speaker 30 indicating to the golfer that the club face 14 was not perpendicular to center line plane 18 and the ball path 42 will be left of desired path to hole. Ref. FIG. 7, if left club face sensor 19 signal was detected before right club face sensor 20, the microprocessor 33 sends one beep to speaker 30 indicating to the golfer that the club face 14 was not perpendicular to center line plane 18 and the ball path 42 will be right of desired path to hole.

Ref. FIGS. 1, 2, 5, 8, 9, 25 & 26, in normal operation, ball 3 is placed on the putter data module 1, the putter 2 with the magnet 15 attached moves over magnetic actuated power switch 8, (or manually switched on with manual power switch 7), to wake up the system, activate the body alignment target 22 and start the metronome. The golfer aligns his head with target 22 base on not seeing any light from reflective left target wall 23 or reflective right target wall 24. The putter 2 is swung back, in time with the metronome, and then forward to strike ball 3.

Microphone 31 detects the impact of putter face 14 and ball 3. After a short delay, the end-of-swing indicator, including flashing left target LED illuminator 25 and right target LED illuminator 26 and a short beep from speaker 30, completes the putting stroke. At this time the golfer has had full body follow-through and can move out of the constraint of the body alignment target 22. Based on time signals from left club face sensor 19 and right club face sensor 20, the putter face 14 angle at impact with ball 3 is reported to the golfer using tones from speaker 30. The golfer also receives the putter path 43 feedback based on putter center of gravity indicator tracking the center line plane 18. Tracking down the center of center line plane 18 will illuminate center line LED indicator 27. Otherwise the error left LED indicator 28 or error right LED indicator 29 will illuminate based on the side of the error. When ball 3 is replaced on putter data module 1 the cycle is repeated. Otherwise, if an expected act is not initiated by the golfer in a predetermined time, the device falls asleep to conserve battery power.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A putting training device for improving consistency of body position, putter path, putter face angle, and timing during a putting stroke comprising:

a magnet securable to the C.G. of the putter head;

a data module including:

a body alignment target within said data module for positioning a golfer's head directly over a ball and for aligning a golfer's shoulder consistently relative to the ball;

hall effect sensors within the module for tracking said magnet during each putting stroke to determine whether the putter travels in a straight line on approach to ball strike;

optical sensors in said module focused to determine the putter face angle at ball impact;

a metronome within said module to facilitate consistent swing timing;

an end-of-swing delay indicator in said module for holding the golfer's body in the correct position until the follow-through of each swing is complete; and a series of lights and tones in said module providing feedback indicating putter path to the ball and the putter face angle at ball impact.

2. A putting training device for improving consistency of body position, putter path, putter face angle, and timing during a putting stroke comprising:

a generally flat data module positionable on a flat surface;

a body alignment target within said data module viewable by a golfer for positioning the golfer's head directly over a ball resting on a dimple formed in a top surface of said data module in close proximity to a target and for aligning the shoulder of the golfer consistently relative to the ball;

a magnet securable to the C.G. of the putter head;

hall effect sensors within the module for tracking said magnet during each putting stroke to determine whether the putter travels in a straight line on approach to ball strike;

optical sensors in said module focused to determine the putter face angle at ball impact;

a metronome within said module automatically activated at the start of each practice swing to facilitate consistent swing timing;

an end-of-swing delay indicator in said module for holding a golfer's body in a correct position until the follow-through of each swing is complete;

a series of lights and tones in said module providing feedback indicating putter path to the ball and the putter face angle at ball impact.

3. A putting training device for improving consistency of body position, putter path, putter face angle, and timing during a putting stroke comprising:

a putter having a club head including a magnet secured at the C.G. of the putter head;

a data module including;

an optical body alignment target upwardly oriented for a golfer to position the eyes and head directly over a ball;

hall effect sensors activated by said magnet during each putting stroke to determine whether the putter travels in a straight line on approach to ball strike;

optical sensors focused to determine the putter face angle at ball impact;

a metronome automatically activated at the start of each practice swing to improve consistent swing timing;

an end-of-swing delay indicator for holding the golfer's body in a correct position until the follow-through of each swing is complete;

a series of lights and tones providing feedback indicating putter path to the ball and the putter face angle at ball impact.

* * * * *